United States Patent [19]

Godfrey

[11] Patent Number: 4,591,149

[45] Date of Patent: May 27, 1986

[54] WEIGHT LIFTING CALF EQUALIZER EXERCISING MACHINE

[76] Inventor: Daniel R. Godfrey, 3101 Bray Rd., Virginia Beach, Va. 23452

[21] Appl. No.: 486,115

[22] Filed: Apr. 18, 1983

[51] Int. Cl.[4] ..... A63B 21/06

[52] U.S. Cl. ..... 272/118

[58] Field of Search ..... 272/118, 117, 93, 116, 272/122, 123, 134, 142, 900, DIG. 4

[56] References Cited

U.S. PATENT DOCUMENTS

| | | | |
|---|---|---|---|
| 3,346,256 | 10/1967 | White | 272/118 |
| 3,863,916 | 2/1975 | Cline . | |
| 3,985,354 | 10/1976 | Schulkin . | |
| 4,236,712 | 12/1980 | Lambert, Jr. . | |
| 4,256,302 | 3/1981 | Keiser . | |

FOREIGN PATENT DOCUMENTS

| | | | |
|---|---|---|---|
| 1444065 | 5/1966 | France | 272/118 |
| 502634 | 5/1976 | U.S.S.R. | 272/118 |

*Primary Examiner*—Richard J. Apley
*Assistant Examiner*—William R. Browne
*Attorney, Agent, or Firm*—Sandler & Greenblum

[57] ABSTRACT

A leg exercise device is provided which is especially useful for developing the lower leg muscles associated with the calf. The device is defined by a base support connected to a pair of upwardly extending tubular handlebars. A weight carriage is slidably mounted on the handlebars in a manner that allows a seated exerciser to place his foot under the carriage and uplift the carriage by lifting the front of his foot. A pair of weight bars are also connected to the weight carriage in order to slidably accommodate a standard set of weights. The device discloses an upper leg exerciser in which an upper bar assembly is attached to the front of the weight carriage and the handlebars are pivotally connected to the base support. An exerciser sits in front of the device, and adjusts the handlebars close to the top of his knees. When the knees are raised, the weight carriage slides up the handlebars.

11 Claims, 10 Drawing Figures

FIG. 1
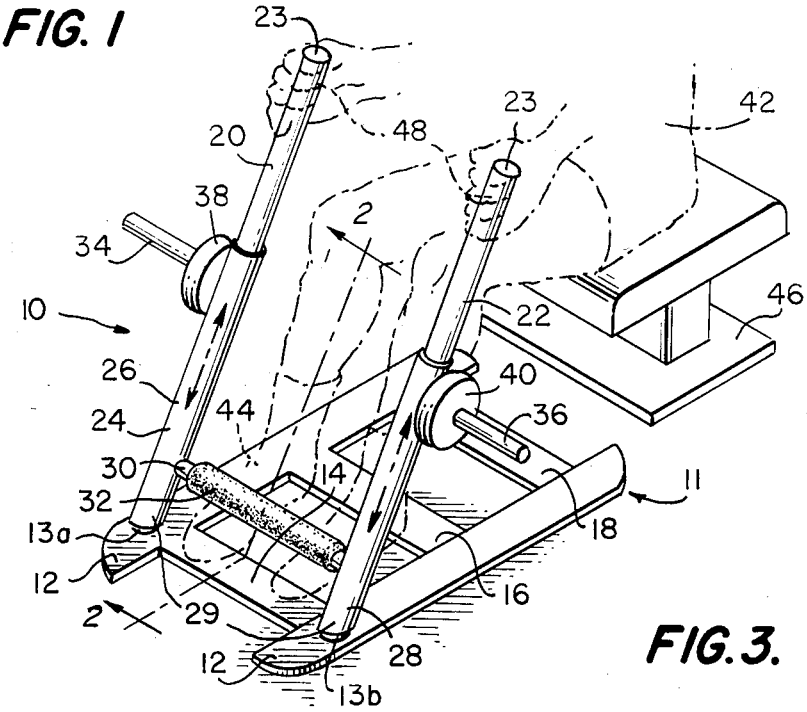
FIG. 3.
FIG. 2.
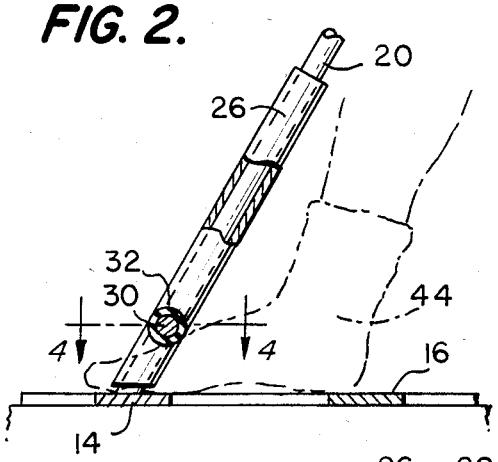
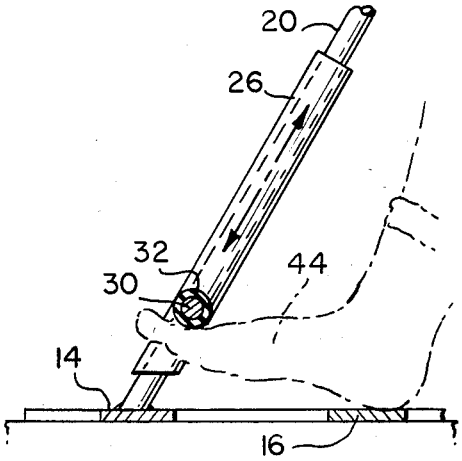
FIG. 4.
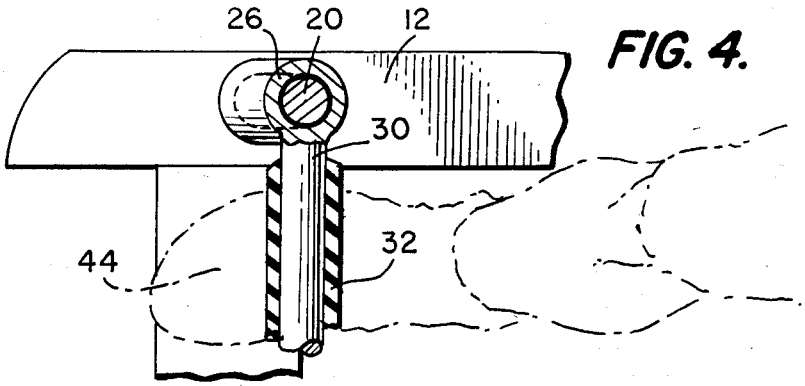

WEIGHT LIFTING CALF EQUALIZER EXERCISING MACHINE

BACKGROUND OF THE INVENTION

1. Field of the Invention

This invention relates to an exercise machine, which is useful in developing the muscles of the lower legs, particularly those muscles associated with the calves and the knees.

2. Discussion of the Prior Art

The recent interest in physical fitness programs for developing muscle tone, as well as the sports of running and jogging, have created a need for devices which are oriented to develop specific muscles of the legs. Devices for exercising and developing leg muscles, particularly those muscles associated with the calf, such as the gastrocnemius, the saleus, the flexor digetourn longus, the peroneus brevis, and the flexor hallucis longus, have been relatively few, despite the importance of these muscles. A runner, for example, commonly suffers from cramps and shin splints. Since these difficulties are concentrated in the muscles of the lower leg, the need to develop these muscles is of prime importance. In addition, the prior art devices which specifically develop these muscles have tended to require either complex exercises or entail structures not well suited for easily exercising the lower leg muscles.

CLINE, U.S. Pat. No. 3,863,916, for example, discloses an exercising device specific to developing lower leg muscles. The user sits in front of this device and places his foot under a pivotable arm, which has an attached weight. The exerciser then slides backward and forward on a chair, pulling up and back on the pivotable arm with his toes. Therefore, the exercise requires a complicated maneuver because the arms of the exerciser are used for both sliding and supporting his body in the chair. Additionally, since the chair is not secured to the exercise machine the exercise depends on the availability of suitable chairs. If the chair is not of the correct width, length, and stability, the user may slip or fall.

LAMBERT, Jr., U.S. Pat. No. 4,236,712, on the other hand, discloses a device for developing the lower leg muscles that is safe and simple to use. The exerciser stands adjacent to a weight machine and selects an appropriate weight. The top portion of the weight machine is adjusted to accommodate the height of the exerciser. Shoulder pads, which are movably connected to the top portion of a frame that supports the weights, are placed on his shoulders. The exerciser then raises his toes against the resistance of the weighted pads, thereby developing the lower leg muscles. However, while offering a simpler and safer method for exercising, this device occupies a sizable area, and is relatively complex in construction.

KEISER et al., U.S. Pat. No. 4,256,302, disclose an exercising device which is adapted to develop the muscles associated with the thigh and knee. The device includes a cable and pulley system connected to a stack of weights. The operator is seated on the machine and places his ankles behind a padded lever so that straightening the legs will pull the cable and lift the weights. While this exercise is safe and simple, the KEISER mechanism is structurally complex and not portable. Also, the KEISER device is not suited for exercising the lower leg muscles.

SCHULKIN, U.S. Pat. No. 3,988,354, discloses an exercise device which involves a portable machine in which the exerciser must force a pair of vertical bars to telescope by extending a spring biased slidable tube. The user stands on a base bar and holds a top bar connected to the base bar by the vertical bars. When force is applied, the top bar is moved away from the base bar. A simple exercise for developing arm muscles, therefore, is achieved. If the exerciser wishes to develop leg muscles, however, this device becomes cumbersome. The top bar cannot be easily gripped by the legs or feet and the base portion cannot be firmly held to the floor by the upper torso of the user.

In conclusion, the prior art leg exercise devices require either complex and unsafe exercises or entail structures which are complicated, bulky and occupy substantial space, or which are not particularly suited for developing and exercising the lower leg muscles.

SUMMARY OF THE INVENTION

Accordingly, it is an object of this invention to overcome the deficiencies of the prior art by providing an exercise device which is portable, has a simple construction, and can exercise and develop the lower leg muscles by a safe and easy exercise.

It is another object of this invention to provide an exercising device which develops specific muscles including the gastrocnemius, the saleus, the flexor digetourn longus, the peroneus brevis and the flexor hallucis longus.

It is another object of this invention to provide an apparatus in which the amount of work is varied by the magnitude of the weight selected.

This invention provides an exercise apparatus comprising a base support having front and rear ends and a top surface with a pair of parallel handlebars attached to the top surface of the base support in a manner that disposes the handlebars upwardly and rearwardly at an acute angle. Each handlebar has a free upper end that may be gripped by the user. The exercise apparatus has a weight carriage comprising a pair of tubular sleeves adapted to slide along the handlebars and a lift bar connecting the tubular sleeves to each other. In addition, a means for opposing the upward movement of the weight carriage is provided by using adjustable weights.

These and other objects and advantages of this invention will be made apparent when considering the following detailed description, accompanying drawings, and appended claims.

BRIEF DESCRIPTION OF THE DRAWINGS

The above and other objects, features and advantages of the present invention will become more fully apparent to those of ordinary skill in the art to which the present invention pertains from the following detailed description, taken in conjunction with the accompanying drawings in which:

FIG. 1 is a perspective view of a first embodiment of an exercising device in the present invention;

FIG. 2 is a side view of the device of FIG. 1 taken along line 2—2 in FIG. 1;

FIG. 3 is a side view of the device in FIG. 1 showing a foot lifting the weighted carriage;

FIG. 4 is a top view of the device of FIG. 1 taken along line 4—4 of FIG. 2;

DETAILED DESCRIPTION OF THE INVENTION

Figure 5:
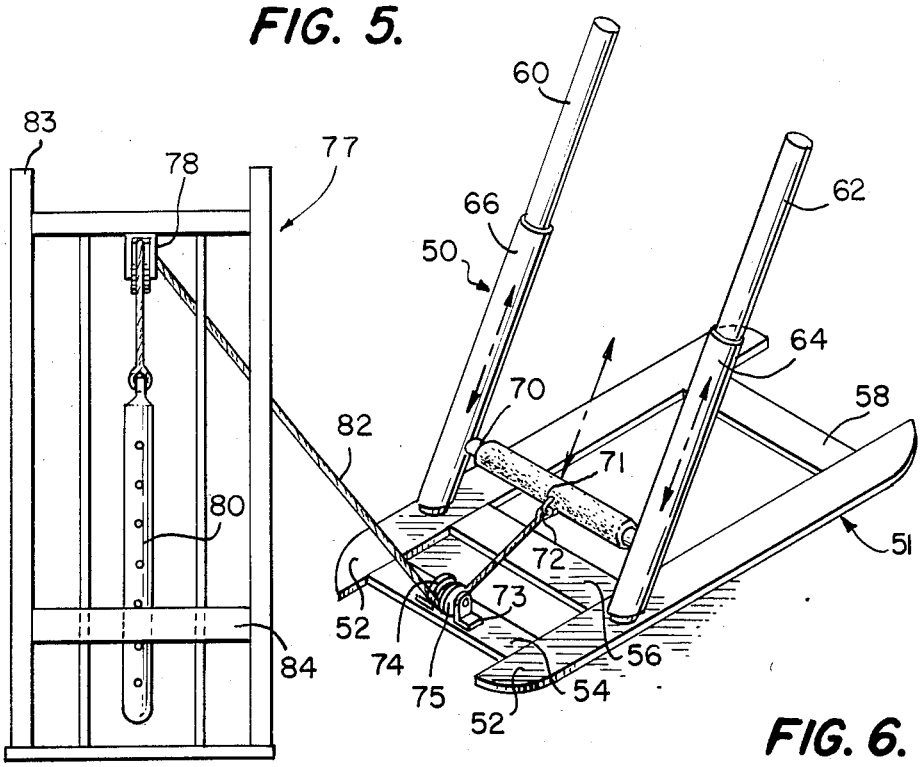
FIG. 5 is a perspective view of a second embodiment of the exercising device formed in accordance with the present invention.

Referring specifically to the drawings, wherein like reference numerals refer to like parts throughout the several drawings, FIG. 1 is a perspective view of the preferred embodiment of this device. A leg exercising apparatus 10 includes a base support 11 defined by parallel main rails 12 and shorter connecting rails 14, 16 and 18, which are orthogonal to main rail 12 and mutually parallel. The base is preferably formed of quarter inch thick metal and the widths of front and middle connecting rails 14 and 16 are less than the width of rear connecting rail 18.

Extending upwardly from base support 11 and on either side of front connecting rail 14, are a pair of parallel rod shaped handlebars 20 and 22. The handlebars are connected to main rails 12 by any appropriate method at connection points 13*a* and 13*b*, respectively. Handle bars 20 and 22 are disposed upwardly and rearwardly at an acute angle relative to the longitudinal axis of main rails 12 and in the direction of rear connecting rail 18. The handlebars are made of metal, e.g., steel, and are of sufficient strength and diameter to support standard lifting weights. A pair of hand grips 48 can be mounted on the ends of the handle bars 23 in order to provide improved gripping action for the user.

Weight carriage 24 is attached to handlebars 20 and 22 so that it may slide up and down the handlebars as indicated by the reference arrows in FIGS. 1–3. Weight carriage 24 is defined by metallic tubular sleeves 26 and 28 which concentrically surround handlebars 20 and 22 in order that they may freely slide along the handlebars. Tubular sleeve bases 29 are bevelled to allow the ends of tubular sleeves 26 and 28 to completely engage the surface of main rails 12 when weight carriage 24 is stationary. Tubular lift bar 30, which comprises a metal rod, connects the lower ends of tubular sleeves 26 and 28 at a sufficient height above tubular sleeve base 29 to allow adequate clearance between front connecting rail 14 and bar 30 for foot 44 of an exerciser. A soft pad 32, e.g., sponge rubber, may be secured in any desired fashion to lift bar 30 in order to limit clearance between the top of foot 44 and lift bar 30 and to provide cushioning for the user.

Weight bars 34 and 26 are attached to the upper ends of tubular sleeves 26 and 28 and extend outwardly from exercise machine 10. The weight bars are disposed substantially horizontal relative to base support 11 and are made of metallic rods having a diameter that will slidably accommodate standard weights 38 and 40 thereon. The length of weight bars 34 and 36 is sufficient to enable the user to place multiple weights on each bar.

Referring to the operation of the device shown in FIGS. 1–4, exercise device 10 is placed on a floor with exercise stool 46 facing rear connecting rail 18 in a position suitable for exercising; this support can be integrally connected to the exercise device if desired. Exerciser 42 sits on exercise stool 46 and grasps handlebar ends 23 with his hands. The heels of foot 44 rest up on middle connecting rail 16 and the toes are positioned beneath lift bar 30 (FIG. 2). Foot 44 lifts at the heel (FIG. 3) so that the toes engage lift bar 30 and slide weight carriage 24 up tubular sleeves 20 and 22, as indicated by the reference arrows in FIG. 3. After pulling up the carriage, the user lowers his foot releasing the weight, so that the foot will return to the position shown in FIG. 2. Such movement of one or both feet is repeated until the lower legs are completely exercised. The user may vary resistance by adding or subtracting weights 38 and 40 as required.

A second embodiment 50 of the device is illustrated in FIG. 5; it includes a base support 51 defined by parallel main rails 52 and transverse connecting rails 54, 56 and 58. Pulley assembly 74 is mounted at the longitudinal midpoint of front connecting rail 54 on a pair of upwardly extending parallel support plates 73 having apertures located at their upper ends. A camming means 75, which comprises a cylindrical disk/pulley having a circumferential groove, is rotatably mounted on parallel support plates 73 in a suitable manner. On either side of middle connecting rail 56, and attached to main rails 52, are handlebars 60 and 62, which are connected and disposed upwardly and rearwardly. Tubular sleeves 64 and 66 concentrically surround handlebars 60 and 62 and are connected to each other by central lift bar 70. Cable attachment means 72 is located at the midpoint of lift bar 70 by hook 71. The weight system 77, which is similar to conventional universal-type weight machines, consists of a weight cage 83 having pulley arrangement 78 attached to the top end of cage 83. A plurality of stacked rectangular weights 84 can be attached or released from engagement with weight shaft 80 by means of a suitable connecting pin (not shown). Weight system 77 is located adjacent to leg exercise machine 50. Cable 82 is connected to lift bar 70 at cable attachment means 72 and passes underneath cylinder 75. Cable 82 extends around pulley 78, which is located at about sixty inches above pulley 74. Cable 82 is attached to weight shaft 80 by any appropriate method.

Operation of the device of FIG. 5 is substantially the same as that illustrated in FIGS. 1–4; the heel of foot 44, however, is placed on the floor rather than on middle connecting rail 56.

Figure 6:
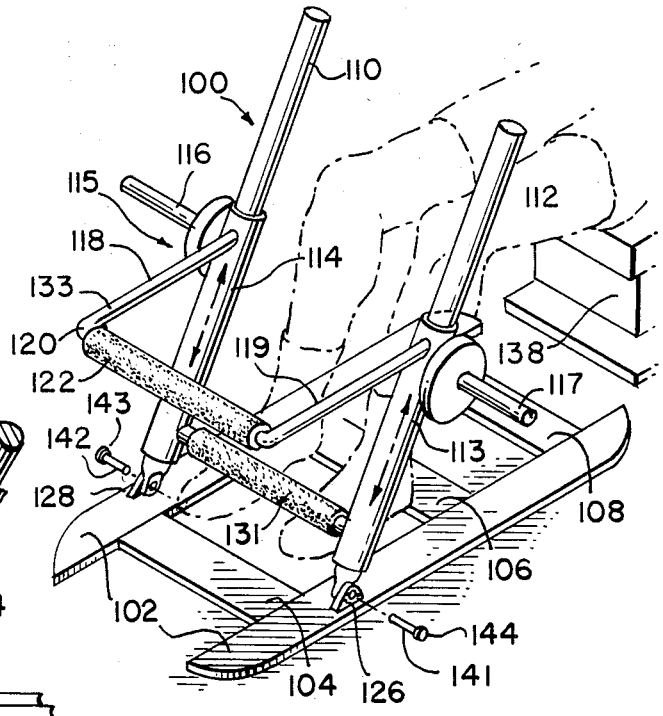
FIG. 6 is a perspective view of a third embodiment of the present invention.
Figure 7:
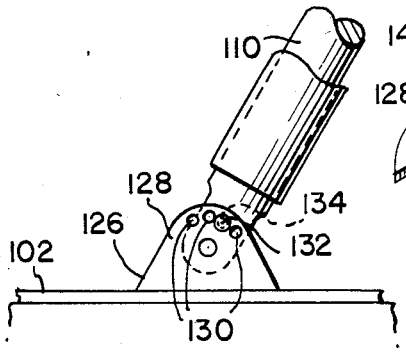
FIG. 7 is a side view of an adjustable pivot used in the device of FIG. 6.

Referring to FIG. 6, a third embodiment 100 of the device is disclosed wherein base support 101 is defined by parallel main rails 102 and transverse connecting rails 104, 106 and 108. Adjustable pivots 126 are attached to the top surface of each respective main rail 102 at a point located between connecting rails 104 and 106. As shown in FIG. 7, each adjustable pivot 126 comprises an arcuately shaped vertically upstanding member 128 attached to a respective main rail 102. Pivot arcuate member 128 has a plurality of apertures 130 spaced along its upper circumference. A complementary male pin member 132 passes through aperture 130 and extends to fit within associated aperture 134 located at the base of handlebar 110. Pin 132 associates with an appropriate lock means so that it is held in a stationary manner when inserted into aperture 134. Handle bars 110 and 112, therefore, can be pivoted into a plurality of desired stable positions by disengaging and then reinserting the pins at desired apertures 130 and 134, on a respective adjustable pivot 126 and handlebar 110 or 112.

Weight carriage 115 consists of tubular sleeves 113 and 114, weight bars 116 and 117, lift bar 131 and upper bar 133. Upper bar 133 is defined by a pair of metal rods 118 and 119 attached to the front facing upper portions of tubular sleeves 113 and 114 so that the upper bar extends toward the front of base support 101. Contact bar 120 connects rods 118 and 119 at their termini, forming a U-shaped upper bar. A soft pad 122, e.g., soft rubber or foam, is attached to rod 120 by any appropriate method.

Weight carriage 115 has a pair of handlebar locks having apertures 140 and 141 located at the base of tubular sleeves 113 and 114 which communicate with a respective pair of apertures (not shown) located near the base of handlebars 110 and 112. A pair of handlebar pins 143 and 144 of appropriate length and diameter are inserted through apertures 141 and 142 in order to lock tubular sleeves 113 and 114 to the handlebars. When locked, lift bar 131 is positioned at a height above base support 101 to enable an exerciser to easily insert his feet beneath the lift bar.

Figure 8:
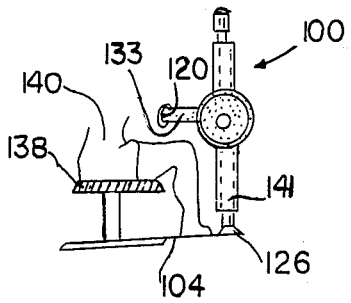
FIG. 8 is a side view of a method for adjusting the device of FIG. 6.
Figure 9:
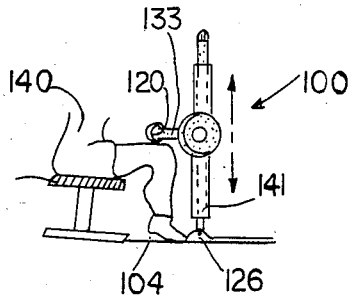
FIG. 9 is a side view of one method of operating the device of FIG. 6.

Referring now to the operation of the device of FIG. 6, FIGS. 8 and 9 show operation of leg exerciser 100 as a knee and thigh exercise unit. Exercise stool 138 is placed in front of connecting rail 104 in a position suitable for seating exerciser 140. If adjustment is desired, pin 132 can be removed (see FIG. 7) from adjustable pivot 126, and handlebars 110 and 112 can then be pivoted toward the front of base support 101. The appropriate angle for handlebars 110 and 112 can be determined by adjusting the knee bar to the closest distance from the knees of seated exerciser 140 as shown in FIG. 8. Pin 132 is reinserted through appropriate aperture 130, and into a respective handlebar aperture 134. The exercisor can then mount the weights on weight bars 116 and 117 and pins 143 and 144 are then removed from mating apertures 140 and 141 in order to unlock weight carriage 115. The exercise is commenced by uplifting the heels of the feet so that the knees engage contact bar 120 and slide weight carriage 115 upward, as indicated by the reference arrows in FIG. 9. After raising weight carriage 115, the heel is lowered and the weight released. Movement of one or both feet is repeated until the legs are exercised.

Figure 10:
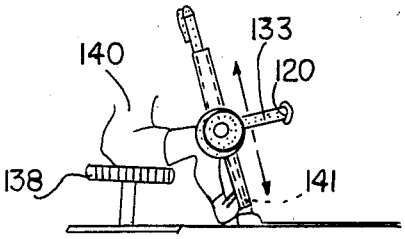
FIG. 10 is a side view of another method of operating the device of FIG. 6.

Operation of the device of FIG. 6 for exercising the lower legs is shown in FIG. 10 and is substantially the same as that shown in FIGS. 1–4 with the exception that handlebar pins 143 and 144 are first removed from apertures 141 and 142 in order to unlock the weight carriage.

Weight resistance can be varied in the same manner shown in all three embodiments, because the amount of weight is adjustable, depending on either the number of weights the exerciser slides onto the weight bars in the first and third embodiments, or the number of weights he chooses from the weight stack in the second embodiment.

Although the present invention has been described with respect to specific features, embodiments and advantages, it is clear that a variety of such embodiments, features and advantages can be contemplated within the scope of the present invention.

What is claimed is:

1. An exercise device for developing the muscles of a user, said exercise device comprising:

(a) a base support having a front end, a rear end, a bottom surface and a top surface;

(b) a pair of parallel handlebars, each of said handlebars having a lower end connected to the top surface of said base support and being disposed upwardly and rearwardly at an acute angle from said base support, each of said handlebars having a free upper end;

(c) a weight carriage comprising a pair of tubular sleeves, each sleeve being adapted to slide along a respective one of said handlebars, and a pair of outwardly extending, substantially horizontal weight bars connected to said tubular sleeves, said weight bars comprising means for receiving standard lifting weights, said device further comprising a pair of horizontally disposed parallel rods connected to said tubular sleeves and extending towards the front end of said base support, said device also comprising a leg contact bar connecting said parallel rods to form a generally U-shaped upper bar, and a tubular lift bar connecting said tubular sleeves, said lift bar being adapted to be engaged by a portion of the body of a user; and (d) weight resistance means adjustably connected to said weight carriage for opposing upward movement of said weight carriage.

2. The device of claim 1 wherein said base support comprises a pair of parallel main rails connected by three spaced mutually parallel connecting rails which are transverse to said main rails.

3. The device of claim 1 wherein said lift bar is padded.

4. The device of claim 1 further comprising a support means for supporting the user in a sitting position.

5. The device of claim 1 wherein said adjustable means for opposing upward movement of said weight carriage comprises at least one lifting weight.

6. The device of claim 1 further comprising a pair of adjustable pivots each mounted on said base support and having a plurality of arcuately disposed apertures.

7. The device of claim 6 further comprising a pin for inserting through said apertures of each respective of said adjustable pivots.

8. The exercise device of claim 7 wherein said handlebars have apertures adapted to be placed in axial alignment with the apertures of the adjustable pivot, said handlebar aperture being adapted to accommodate the insertion of said pin in order to allow said handlebars to pivot.

9. The device of claim 8 further comprising padding on said leg contact bar.

10. The exercise device of claim 9 further comprising a handlebar lock on each of said tubular sleeves wherein handlebar aperture lock is located in each sleeve and communicates with a respective aperture in each of said handlebars.

11. The exercise device of claim 10 further comprising a pair of handlebar pins for inserting through said bar apertures.

* * * * *